United States Patent [19]

Fujihiro et al.

[11] 4,422,278

[45] Dec. 27, 1983

[54] PANEL FITTING DEVICE

[75] Inventors: Sanae Fujihiro, Yokohama; Sigeyaki Matuda, Kasukabe, both of Japan

[73] Assignee: Toko Kogyo Co.Ltd., Japan

[21] Appl. No.: 270,891

[22] Filed: Jun. 5, 1981

[30] Foreign Application Priority Data

Aug. 22, 1980 [JP] Japan ..... 55-115749

[51] Int. Cl.[3] ..... E04B 5/52

[52] U.S. Cl. ..... 52/714; 52/478; 52/547

[58] Field of Search ..... 52/547, 548, 550, 478, 52/357, 358, 359, 360, 712, 520, 543, 714

[56] References Cited

U.S. PATENT DOCUMENTS

| | | | |
|---|---|---|---|
| 670,753 | 3/1901 | Abeleven | 52/547 |
| 757,285 | 4/1904 | Duchemin | 52/547 |
| 1,595,718 | 8/1926 | Graham | 52/359 |
| 1,974,372 | 9/1934 | Taylor | 52/547 |
| 2,307,899 | 1/1943 | Olsen | 52/357 |
| 2,641,035 | 6/1953 | Nelsson | 52/358 |
| 2,661,568 | 12/1953 | Stark | 211/42 |
| 3,305,994 | 2/1967 | Amrhein | 52/548 |

FOREIGN PATENT DOCUMENTS

| | | | |
|---|---|---|---|
| 143612 | 3/1950 | Australia | 52/547 |
| 330554 | 6/1930 | United Kingdom | 52/537 |

*Primary Examiner*—Henry F. Raduazo
*Attorney, Agent, or Firm*—McGlew and Tuttle

[57] ABSTRACT

A panel fitting device comprises a main part made of wire rod or plate material and a pressing part made of the same material connected together at one end so that they form a clearance for receiving an upper panel, and the other end of the main part has a supporting leg to hitch a base material such as a C-shaped channel. When the base material is hitched by the supporting leg and the main part and the pressing part are turned clockwise, the top part of the lower panel is caught between the main part and the base material, and then, the bottom end of an upper panel is inserted into the aforementioned clearance and the upper and lower panels can thus be easily installed.

10 Claims, 10 Drawing Figures

PANEL FITTING DEVICE

BACKGROUND OF THE INVENTION

This invention concerns a panel fitting device, i.e. a device suitable for fitting and replacing corrugated synthetic resin plates to be used for the roof, wall and gable of a hothouse.

Generally a hothouse is used to cultivate vegetables, fruits and flowers and to breed fish, and the hothouses popularly used are the glass house which uses transparent or semitransparent glass plates on the roof, wall and gable and the vinyl house which is covered by transparent or semitransparent vinyl sheet material.

A glass house has various shortcomings, however. The vegetables and fruits are poor in quality as compared with natural ones (e.g. pear, tomato, etc. are not well colored) for example, due to the low transmission (less than 90%) of sun light, especially ultraviolet rays. Glass is easy to break when an external force such as human body weight is imposed or when rocks, roof tiles, trees, etc. blown by strong wind hit the glass. Also the broken pieces of glass drop into the soil in the hothouse, and are very difficult to remove. The price of glass itself is high and the construction cost will be very high when it is used all around the hothouse. Glass plate is limited in size and cannot be used for a hothouse with large frontage and many fastening parts are required.

The vinyl house can be more easily constructed and is cheaper than the glass house, but it too has shortcomings. Because of its thinness, it has poor durability; it is easily broken by external forces such as wind and rain and it cannot withstand human body weight. Vinyl also has poorer light transmission than glass and when it becomes dirty, it cannot be cleaned easily. It is difficult to stretch and set the vinyl sheet; many fitting parts are required that increase the cost; it is very difficult to replace or maintain because the sheet is easy to break; and sunlight transmission decreases as it becomes dirty.

For the above reasons, recently a hothouse using corrugated panels made of acrylic resin only has been developed and is being used increasingly in place of the glass house and vinyl house.

The acrylic panel is superior in transparency, ultraviolet ray transmission, weather-proofing, and heat reserving quality and is an ideal covering material for the hothouse or similar house. The acrylic panel has the following advantages: (1) since there is no loss in diffusion, reflection and absorption of light and the light transmission is 93% or more, plant disease is prevented and fruits are well colored, (2) no separation of resin and fiber or cloudiness (whitening) which are often found in composite material and no penetration of rain water into the interior or contamination takes place, (3) feating excellent tensile strength and breaking strength and having a usage life of 20 years or more, it withstands typhoon or strong winds and other external forces, and therefore there is little need for maintenance or replacement, (4) the house can be made airtight and energy savings can be expected, (5) various sizes and specifications are available, construction is easy, and large size houses can be built, and (6) construction cost can be reduced because it is cheaper than glass.

Despite the fact that the acrylic panel has such advantages as described above, it has a serious shortcoming as described below because it must be installed by means of hook bolts inserted into holes drilled in the panel and no other better way has so far been developed.

When the transparent corrugated acrylic panels are used on the roof, wall and gable of a hothouse, they are placed one upon another as shown in FIG. 1. The lower acrylic panel at 1 and 2 is placed on a pipe or C-shaped channel 23 which is part of the framework of the hothouse, and the upper acrylic panel 2 is plced upon the lower panel with an unwoven acrylic packing 24 in between, and then, a hook bolt 25 is inserted into the bolt hole drilled in the upper acrylic panel 2. The hook 26 of the hook bolt 25 is hitched in the bent part of the pipe or C-shaped channel 23 and tightened with the nut 29 under which the rubber packing 27 and washer 28 are placed. The top end of the lower acrylic panel 1 is caught rather loosely between the C-shaped channel 23 and the upper acrylic panel 2 so that it can expand or contract in summer and winter.

However, one of the serious shortcomings of the above method is that the bolt hole must be drilled in the upper acrylic panel 2, and in addition, it has also the following shortcomings. (A) Since the acrylic panel 2 is rigid, cracks occur around the hole when the bolt hole is drilled with a tool and the cracks expand all over the panel, (B) there is a lot of work because multiple holes must be drilled in the upper panel 2 and utmost care must be exercised so that the cracks will not occur, (C) even if the drilling work is safely done, the stress will be concentrated around the bolt hole during long usage due to typhoon or other external forces such as a man stepping on the panels, thus causing complicated cracks around the bolt hole and finally replacement will be necessary, (D) the parts cost is very high because many parts such as hook bolts 25 and packings 27 must be used in the multiple holes, (E) two workers are required, one for hitching the C-shaped channel 23 with the hook bolt 25 and another for tightening the nut 29 thus increasing the labor cost and also the fitting is difficult work, (F) if the rubber packing 27 is worn, rain water or cold air comes into the hothouse and its heat reserving quality and airtightness will be impaired.

SUMMARY OF THE INVENTION

The objective of this invention is to provide a fitting device for connecting the corrugated acrylic panels without drilling holes in the panels.

Another objective of this invention is to provide a fitting device for an easy and improved way of installing and removing the acrylic panels.

Another objective of this invention is to provide a fitting device for the plates to be used on the roof, wall, etc. of the hothouse.

Still another objective of this invention is to provide a fitting device by which deformation or damage can be prevented even if a bending stress is imposed on the panel.

To achieve the above objectives, a clearance for taking in a plate is formed between the main part and the holding part made of wire rod or plate, and the main part has at one end a supporting leg extending downwardly, and when the supporting leg is hitched in the framework, two opposite facing plates are secured, one in the clearance and another between the main part and the framework.

Figure 3:
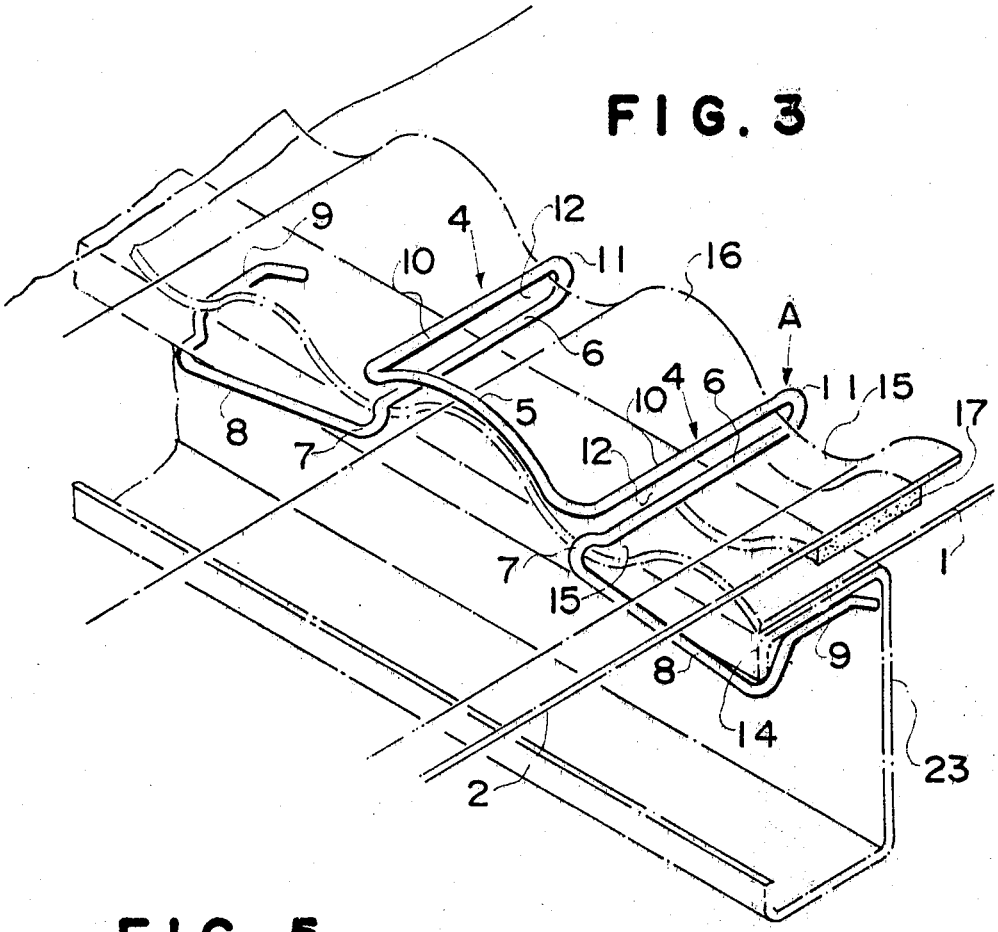
FIG. 3 is a perspective view of the panels jointed with the device in FIG. 2.
Figure 4:
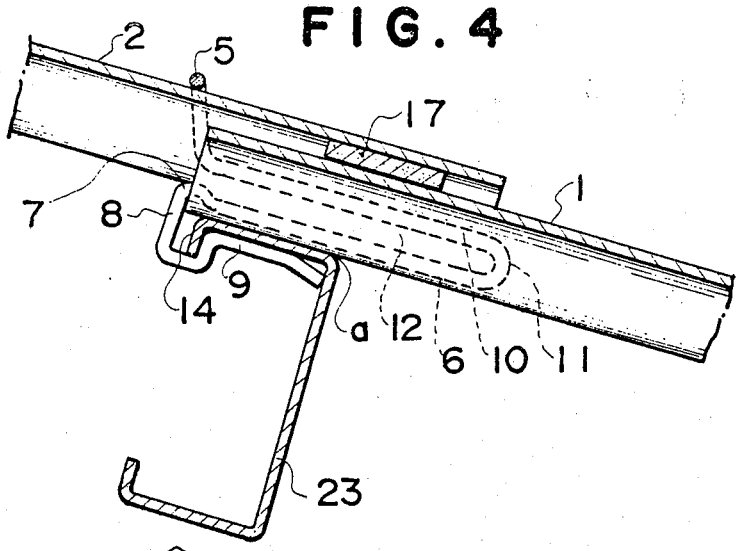

Device of FIG. 4 is a longitudinal side view of the FIG. 3.

Figure 5:
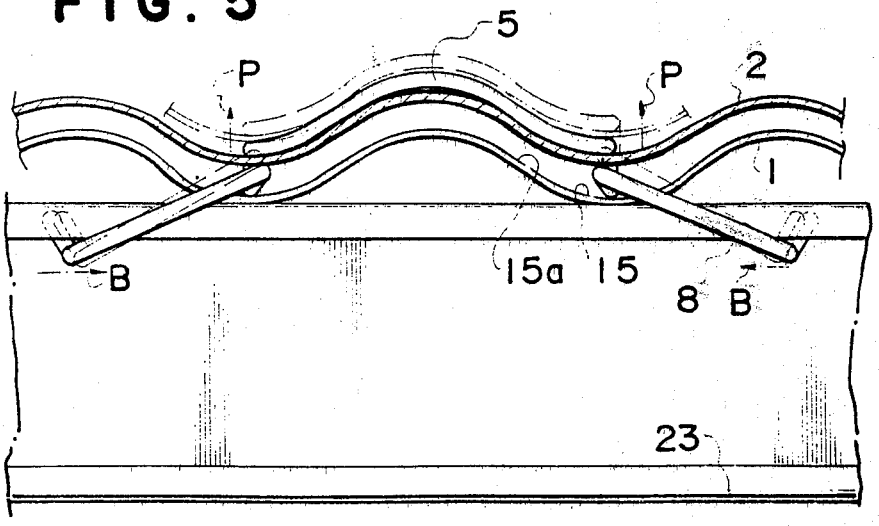

Device of FIG. 5 is a longitudinal front view of the FIG. 3.

Figure 6:
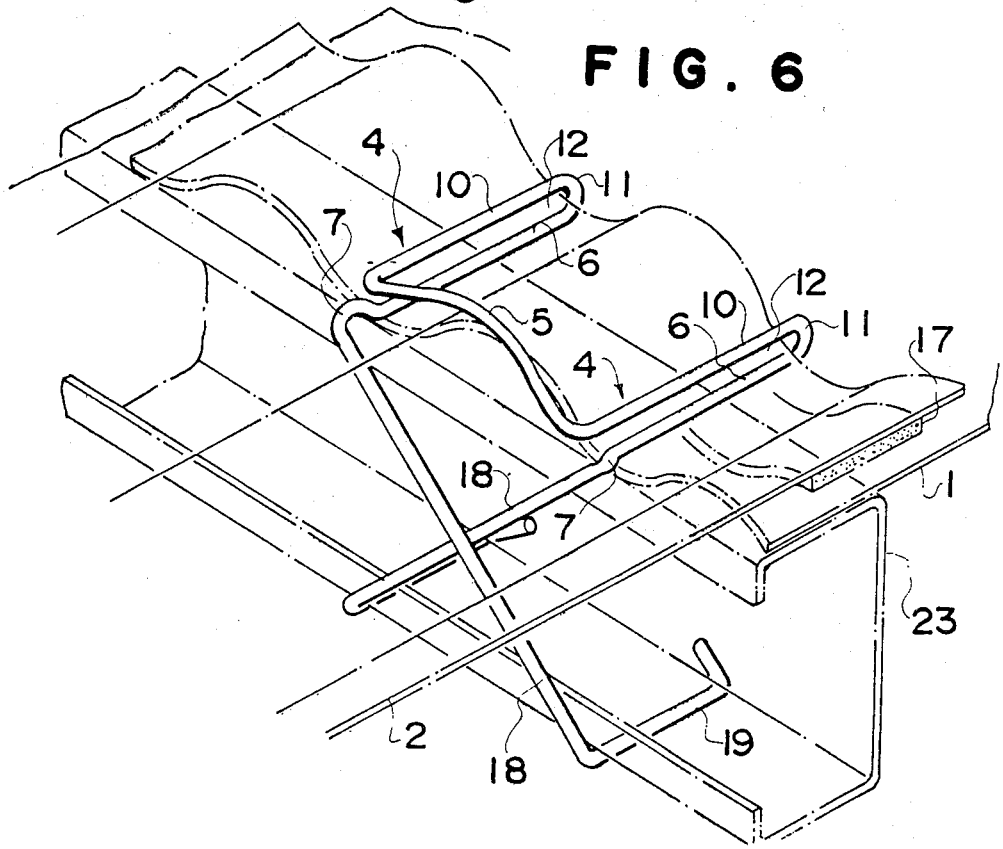

FIG. 6 is a perspective view showing the panels secured by the panel fitting device, according to another embodiment of the invention.

FIG. 7, FIG. 8, FIG. 9 and FIG. 10 are inclined perspective views showing the panels secured by the panel fitting devices, according to other embodiments of this invention.

DESCRIPTION OF THE PREFERRED EMBODIMENTS

The following will describe one embodiment of this invention in accordance with the drawings.

Figure 1:
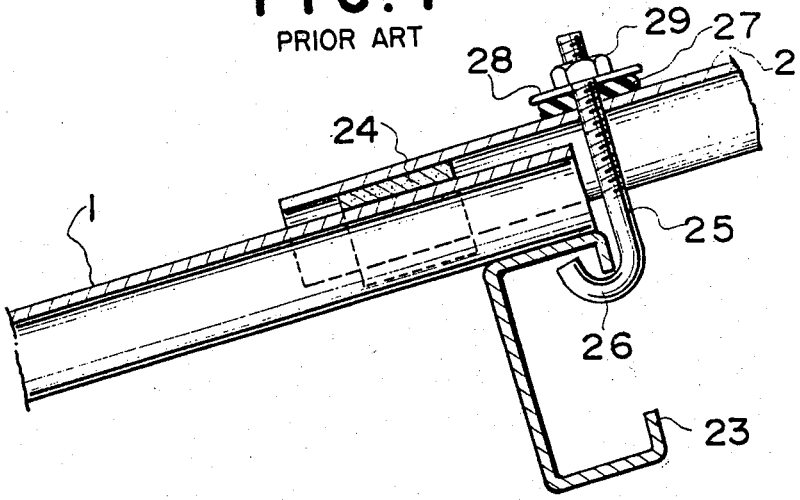
FIG. 1 PRIOR ART
FIG. 1 is a longitudinal side view of the conventional plate fitting device.
Figure 2:
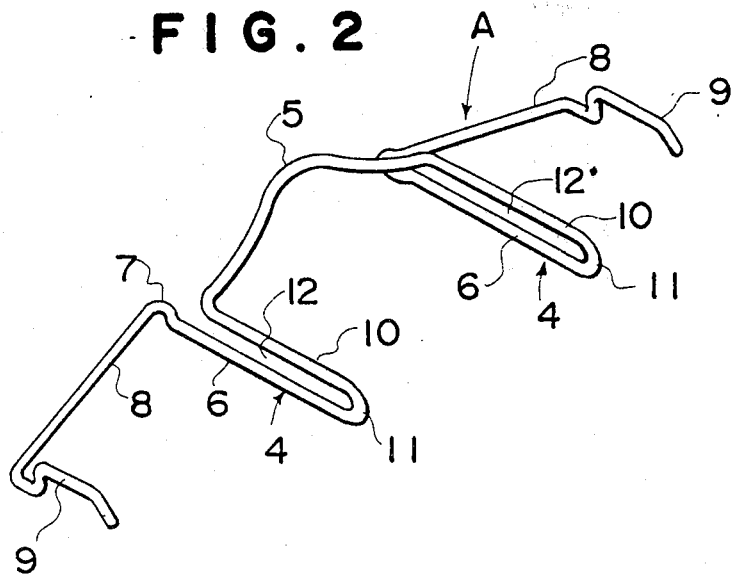
FIG. 2 is a perspective view of the panel fitting device, according to one of the embodiments of this invention.

The fitting device A in FIG. 2–FIG. 4 comprises of two panel holding sections 4 and 4 running in parallel at right and left and a panel pressing section 5 which is curved or mountain-shaped.

The panel holding section comprises the horizontal main part 6 made of wire rod, one end of which is bent inwardly to form a curved relief 7 from which a supporting leg 8 is extended obliquely downwardly, and then this supporting leg is bent backwardly to form a hitching part 9 which runs almost in parallel with the panel holding section 4. And the other end of the main part 6 is bent upwardly and turned to form the pressing (holding) part 10, and the two pressing (holding) parts at the right and left are connected by the panel pressing section 5. It is preferable that the pressing section 5 is inclined toward the main part 6 by means of the curve 11 to have a spring effect, and the main part 6 and pressing part 10 form a clearance 12 to accept a panel. The panel pressing section 5 made of metallic wire rod, etc. is bent to meet the shape of the corrugated acrylic panels 1 and 2 which are mountain-shaped or corrugated as shown in the drawing.

Using the above fitting device A the lower and upper acrylic panels 1 and 2 are connected one upon another in the following way.

The bent part 14 of the base material (framework), for example, C-shaped channel 23 is hooked by the hitching part 9, and the lower acrylic panel 1 is placed on the C-shaped channel 23 and then, referring to FIG. 4, the main part 6 and pressing part 10 are forced clockwise, so that the main part 6 and the C-shaped channel 23 grip the valley 15 of the lower corrugated acrylic panel 1 under pressure.

The main part 6 can be easily inserted if the supporting legs 8 and 8 are pressed inwardly, a toward each other, to widen the distance between the main part 6 and the hitching part 9. When the pressure is released after the installation, the supporting legs 8 and 8 will return to their original positions with their own spring effect thus reducing the distance between the main part 6 and the hitching part 9 and the main part 6 will be firmly installed.

As another installation method, the C-shaped channel 23 is hooked by the hitching part 9 on the right, and then, with the lower acrylic panel 1 held temporarily by the two main parts 6 and 6, the supporting leg 8 and the hitching part 9 on the left are bent against the spring force to hook the C-shaped channel 23. When the spring force of the supporting leg 8 and the hitching part 9 is strong, this method may be easier.

Then, the upper acrylic panel 2 is inserted into the clearance 12 between the main part 6 and the pressing part 10 so that the valley of the panel 2 is gripped between the main part 6 and the pressing part 10 and the acrylic panel is pressed by the pressing part 10 with the spring force of the curved part 11. Therefore, the upper acrylic panel 2 is held firmly by the gripping force between the main part 6 and the pressing part 10 and under the pressure of the panel pressing section 5. Also packing 17 is provided between the two panels 1 and 2 prevents loosening, moving and rubbing damage and also acts as a cushion against external forces.

Referring to FIG. 4, if the lower acrylic panel 1 is pressed by external force such as strong wind of a velocity of 20–50 m/sec. or the dropping of a heavy object or a man's weight, the acrylic panel will be depressed point "a" of the C-shaped channel 23 acting as the fulcrum, and then, the end of the acrylic panel 1, i.e. the end of the valley 15 will be raised in the direction of arrow "P" (FIG. 5). Then, the rising force will affect the main part 6 and will force the whole panel holding section 4 upwardly.

This pushing up force is transferred to the supporting legs, 8 and 8 but the supporting legs held by the hitching part 9 cannot move vertically and therefore, move inwardly in the direction of the arrows "B" FIG. 5.

When the supporting legs 8 and 8 move in the B direction, the hitching part 9 will also move in the same direction and it is possible that the holding sections 4 and 4 including the main part 6 go up.

Therefore, the stress concentrated around the end of the valley 15 caused by the external force on the acrylic panel 1 is removed, and the supporting leg 8 will absorb the external force by its cushion or spring effect. The rising amount of the valley 15 is biggest at the end but here is provided a curved relief 7 which prevents the concentration of stress and therefore, no crack, breakage or deformation will occur.

In the above embodiment example, the main part 6 is located in the valley 15 of the acrylic panel 1 and the relief 7 is required but if the distance between the two parallel main parts 6 and 6 is reduced to locate them on the incline 15*a* FIG. 5 of the acrylic panel 1, the main part 6 can move along the incline 15*a* to prevent the concentration of stress when the end of the acrylic panel 1 is raised, and therefore, there is no need of providing the relief 7.

FIG. 6 shows another embodiment example of this invention where the supporting legs 18 and 18 are mutually crossed while FIG. 2 shows the supporting legs 8 and 8 extending obliquely downwardly in mutually opposite directions.

In this case, the main parts 6 and 6 have the curved relief parts 7 and 7 at one end from where the supporting legs 18 and 18 mutually crossed are extended to the hitching parts 19 and 19 which are bent in the parallel direction with the holding section 4 and the hitching parts 19 and 19 hook and secure the base material (framework) such as C-shaped channel 23, pipe, H steel, or L angle as shown in FIG. 6.

Those supporting legs 18 and 18 with spring effect can be forced mutually inwardly to raise the panel holding sections 4 and 4 for easier installation and removing work and can prevent the damage of panel in conjunction with the relief parts 7 and 7. The device without the relief parts 7 and 7 is also usable and other design variation may be possible.

Figure 7:
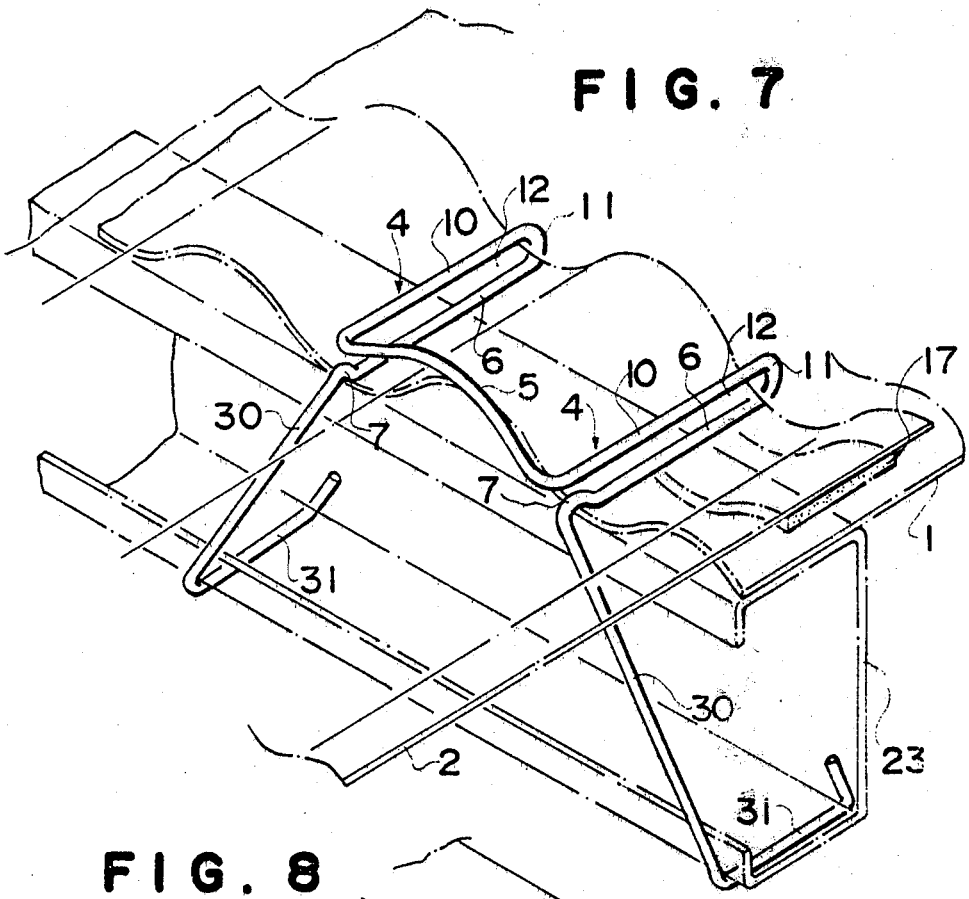

FIG. 7 shows another embodiment example of this invention where the long supporting legs 30 and 30 are provided obliquely downwardly and connected to the L-shaped hook or other type of hitching parts 31 and 31 which hooks and secure the base material such as C-shaped channel 23 as shown in the figure.

The supporting legs 30 and 30 are exactly the same as those in FIG. 2 except longer and have the same spring effect, and if they are forced mutually inwardly, the panel holding section 4 can be raised for easy installation.

Figure 8:
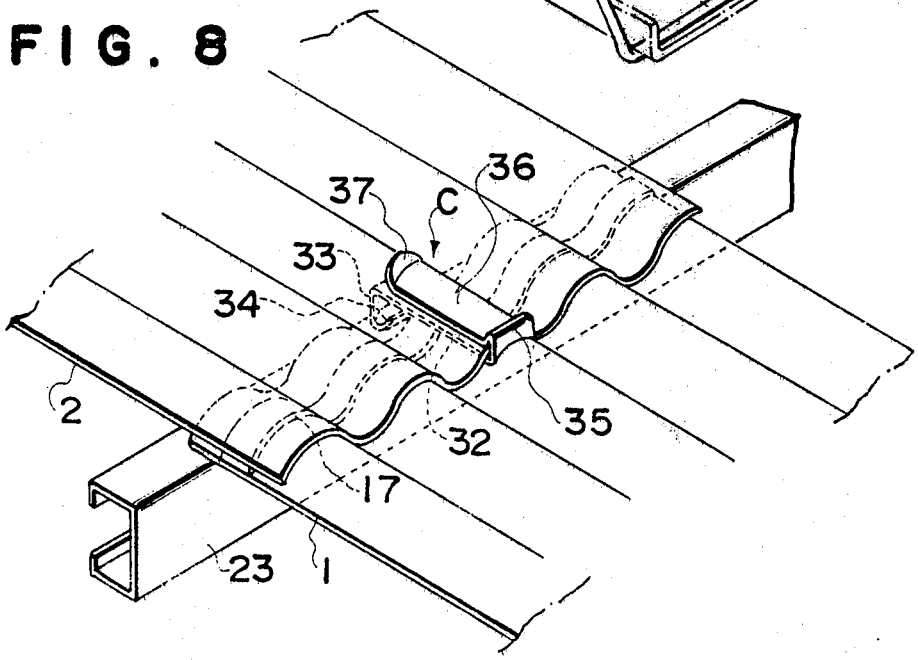

FIG. 8 shows another embodiment example of this invention. The fitting device (C) comprises a horizontal main plate 32 curved at the same curvature as the wave form of the acrylic panel 2, a supporting leg 33 which is one end of the main plate 32 bent vertically downwardly, a hook 34 which is the lower end of the supporting leg 33 bent toward the main plate at an optional angle, a pressing plate 36 which is the other end of the main plate 32 turned toward the upper surface of it by means of the curved section 35 also acting as a spring which has two upper and lower curved parts, and a clearance between the main plate 32 and the pressing panel 36 to grip an inserted plate. The pressing plate 36 is curved at the same curvature as the main plate 32 and has a guide 37 bent upwardly at its end.

When a corrugated panel is held, it is preferable that the main plate 32 and pressing plate 36 have the same curvature as the wave form of the corrugated panel (a device with a flat main plate and a flat pressing plate is also usable) but they do not have to be curved if they are to be used on a flat panel. The curved section 35 connecting the main plate 32 and pressing plate 36 is provided to give a spring force to the pressing plate 36.

The guiding part 37 is provided to give a smooth guidance to the upper acrylic panel 2 when it is inserted into the clearance but the device without it is also usable.

Using the fitting device C, the upper and lower acrylic panels 1 and 2 are connected one upon anotherin the following way.

Firstly, the lower acrylic panel 1 is placed on the C-shaped channel 23, and then, the hitching part 34 is hooked to the L-shaped bent part 14 of the C-shaped channel 23 and the device is turned clockwise forcefully with the hitching part 34 as the fulcrum so that the main plate 32 contacts the lower acrylic panel 1. Thus the fitting device is fixed on the C-shaped channel 23 and the lower acrylic panel 1 by means of the spring force of the supporting leg 33 and main plate 32 and the holding power of the hitching part 34, and the lower acrylic panel 1 is gripped firmly between the C-shaped channel 23 and the main plate 32.

An acrylic unwoven packing 17 is stuck traversely on the acrylic panel 1, and because of the cushion and friction effect of this packing 17 which also closely contacts the under surface of the main plate 32, the loosening and moving of acrylic panel 1 and also the damage to the panel are prevented and the improved airtightness and heat reserving quality are provided.

Then, the upper acrylic panel 2 is inserted into the clearance between the main plate 32 and the pressing plate 36 with the remaining part resting upon the lower acrylic panel 1.

Since pressing plate 36 has the downward spring force by means of the curved section 35, the upper acrylic panel 2 is firmly gripped between the pressing plate 36 and the main plate 32, and because of the packing 17 provided between the lower acrylic panel 1 and the upper acrylic panel 2, the loosening, movement and damage of the upper acrylic panel 2 are prevented and the airtightness is secured between the panels 1 and 2.

Since the upper and lower panels 1 and 2 are only secured by the fitting device C without using bolts, they can move longitudinally freely when expanded in summer and contracted in winter so that deformation or damage is prevented.

The fitting devices C can be installed at an optional interval along the C-shaped channel 23 so that the important points of the panels 1 and 2 are fixed.

Figure 9:
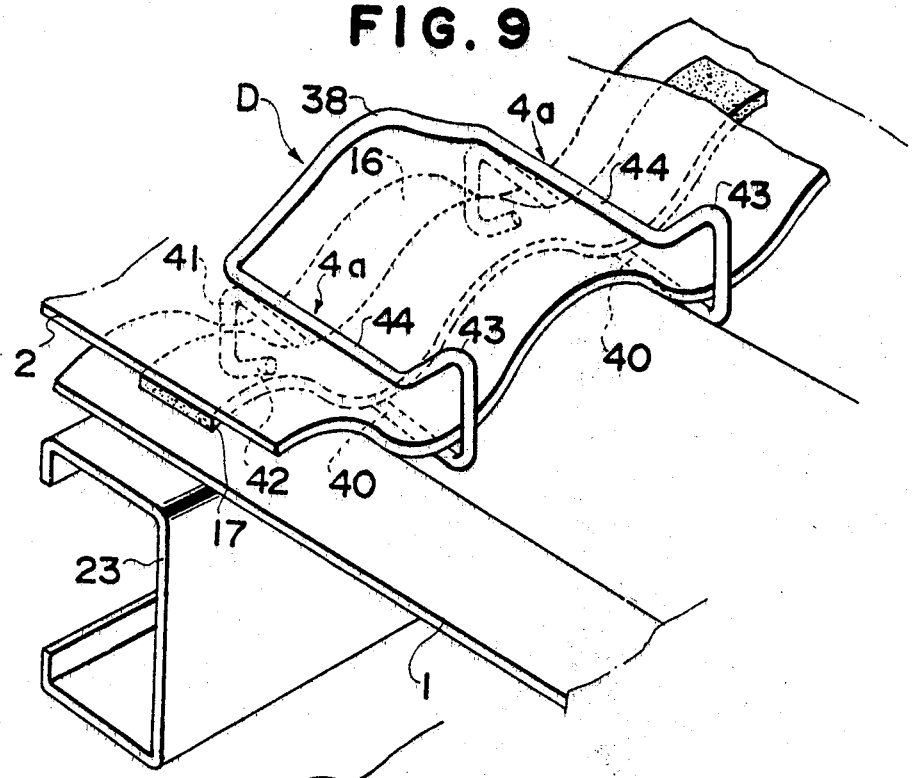

FIG. 9 shows another embodiment example of this invention. The fitting device D comprises two right and left panel holding parts **4*a* and 4*a* running in parallel and a bow-shaped panel pressing section 38 connecting the holding parts 4*a* and 4*a***.

The panel holding section **4*a* comprises a horizontal main part 40, one end of which is bent to form the supporting leg 41 and hooking (hitching) part 42, with the other end bent upwardly to provide the curved part 43 and the pressing part 44, and these two right and left pressing parts 44 and 44 are connected by the panel pressing section 38. The pressing part 44 is inclined from the curved part 43 toward the main part 40 to produce the spring effect and there is provided a clearance between the main part 40 and the pressing part 44 for receiving the inserted panel. The panel pressing section 38 made of metallic wire rod is bent in the same shape as the corrugated acrylic panel 2** like a bow as shown in the figure.

Using the fitting device D, the two upper and lower acrylic panels 1 and 2 are connected one upon the other as follows.

The lower acrylic panel 1 is placed upon the C-shaped channel 23 and the hitching part 42 is hooked to the bent part 14 of the C-shaped channel 23, and then, the supporting leg 41, main part 40 and pressing part 44 are forcefully turned clockwise (see FIG. 9) so that the lower panel 1 is gripped firmly between the main part 40 and C-shaped channel 23. Thus the fitting device D is fixed on the C-shaped channel 23 and the lower acrylic panel 1.

Then, the upper acrylic panel 2 is inserted into the clearance between the main part 40 and pressing part 44 so that the valley 15 of the panel 2 is gripped between the main part and pressing part 44 which presses the acrylic panel 2 with the spring force of the curved part 43. The bow-shaped panel pressing section 38 is attached to the upper surface of the high curved part 16 of the upper acrylic panel 2 and pressed down to the panel by the spring force of the curved part 43 and the pressing part 44. Therefore, the upper acrylic panel 2 is securely held in the clearance with the gripping force of the main part 40 and pressing part 44 and the pushing pressure of the panel pressing section 38. Also the packing 17 provided between the upper and lower acrylic panels 1 and 2 prevents loosening, moving and rubbing damage and provided a shock absorbing effect against the external force.

Figure 10:
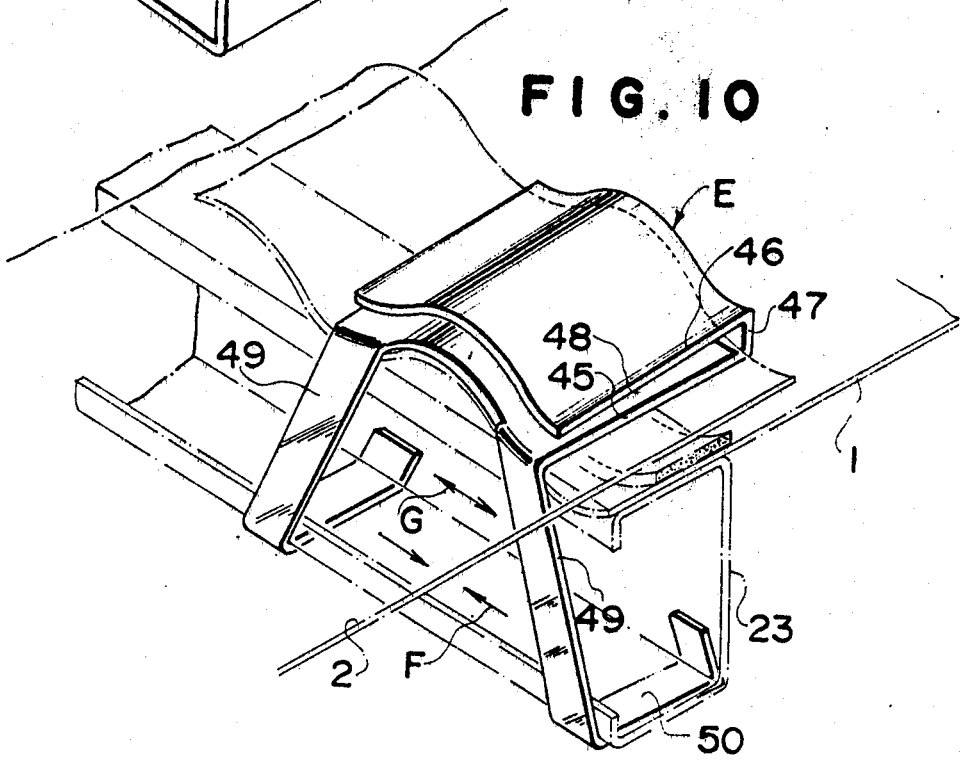

FIG. 10 shows another embodiment example of this invention. This device comprises two waved or bowed plates, main plate 45 and pressing plate 46, a connecting piece 47 to connect them, a panel inserting clearance 48 formed between the main plate 45 and pressing plate 46, and two long supporting legs 49 extended vertically or obliquely downwardly from one end of the main plate 45. The supporting leg 49 has a L-shaped hitching part 50 and the length is made almost the same as the height of the C-shaped channel 23 and the length of the hitching part 50 is made almost the same as the width of the C-shaped channel.

Although the hitching part 50 in the FIG. 10 is formed in the L-shape, it is not necessarily limited to that shape, and it can be adequately bent to fit the external shape of the base material (framework) such as pipe, angle, pillar, etc. and the proper length can be chosen.

If, therefore, the fitting device E in FIG. 10 is to be used on the C-shaped channel 23, a representative base material, the hitching part 50 is hooked under the C-shaped channel 23 and the main plate 45 and pressing plte 46 are turned clockwise with the supporting 49 in contact with the side of the C-shaped channel so that they will be positioned in parallel with the C-shaped channel 23 to grip the lower acrylic panel 1 between the main plate 45 and the C-shaped channel. In another way of installation, the lower acrylic panel 1 is held between the pain plate 45 and the C-shaped channel and the two supporting legs 49 are forced mutually inwardly, i.e. in the direction of the arrow F, and then, the hitching part 50 is hooked under the channel with the supporting legs 49 in contact with the side of the C-shaped channel, and when the arrow direction pressure is released, the supporting legs 49 will return to their original positions with their own spring force causing the hitching part 50 to hook the C-shaped channel 23 firmly and pulling down the main plate 45 and pressing plate 46, and then the main plate 45 presses down the lower acrylic panel 1 to grip it firmly.

Then, the upper acrylic panel 2 is inserted into the clearance 48 and gripped securely between the two plates, main plate 45 and pressing plate 46.

The following will explain the installation of acrylic panels for instance on the hothouse using the fitting devices as described in the above embodiment examples.

The hothouse has square pipes as its framework to which the C-shaped channels are installed transversely to form the beams on which many corrugated acrylic panels 1 and 2 are placed one upon the other by means of the fitting devices of this invention to cover the roof, wall and gable of the hothouse through which sun light come into the hothouse and by which heat is reserved. The ends of the acrylic panels 1 and 2 are held by the flat plates.

As is well known, the acrylic panel is a corrugated plate made solely of acrylic resin which is superior in transparency, ultraviolet ray transmission, weatherproofing, heat-reserving, durability, tensile strength and breakage strength and also is light in weight. It can also absorb impact energy when any external force is applied. If the device of this invention is used:

(a) Since the acrylic panels 1 and 2 are not drilled, drilling work is eliminated which will lead to a cost reduction.

(b) The panels 1 and 2 have no bolt holes and therefore, no need of bolting which means improved installation work and fewer parts—labor-saving and cost reduction.

(c) Since the panels 1 and 2 are not drilled, there is, no fear of panel cracking.

(d) Because of the absence of the holes in the panels 1 and 2, the invasion of rain water and cold air can be prevented and airtightness and heat insulation are secured.

(e) Since there is no hole in the panels 1 and 2, there is no fear of cracks occurring from the hole due to the wind pressure or human body weight.

(f) Since the panels 1 and 2 are only inserted into the fitting devices, the installing and removing work is very much improved.

(g) Labor cost can be reduced because only one person (even a layman) can do the installation work.

(h) The fitting devices are only installed at limited important points—reduced the quantity of parts.

(i) Since the panels 1 and 2 are only gripped and can expand or contract freely depending on the temperature change, there is no fear of breakage.

This invention has been described in detail on the installation of corrugated acrylic panels but the panel may be flat, and the material can be metal, synthetic resin, wood or other similar materials. Also the panels 1 and 2 may be either transparent or semi-transparent or completely opaque materials such as sheets zinc.

The devices of this invention is most suitable for the corrugated panels to be used for the roof, etc. of the hothouse, but they are also usable for the installation of sheets such as zinc sheets of the general houses.

What is claimed is:

1. A panel fitting device for fitting a corrugated panel to a framework member comprising:

a pair of spaced-apart substantially parallel panel-holding sections each comprising a main part and a pressing part connected to one end of said main part and defining a clearance space therewith for receiving an upper panel;

a supporting leg connected to each main part at an opposite end thereof, extending away from said clearance space;

a hitching part connected to each supporting leg at an end of each leg opposite to each respective main part, each hitching part extending substantially parallel to said holding sections and shaped to engage a framework member with a lower panel held between said main part and the framework member;

a panel pressing section connected between each pressing part of each holding section at an end of each pressing part opposite a connection between each pressing part and each main part, said panel pressing section being curved in a direction away from each clearance space for engagement around a corrugation of an upper corrugated panel to be fitted.

2. A panel fitting device according to claim 1, wherein said main and pressing parts, each supporting leg and hitching part are constructed of wire rod.

3. A panel fitting device according to claim 2, wherein said main and pressing parts, each supporting leg and each hitching part are made of a single bent wire rod.

4. A panel fitting device according to claim 13, wherein said support legs extend obliquely downwardly and outwardly from each other, and including a curved relief part connected between each support leg and each respective main part so that each curved relief part curves around and is spaced away from an edge of a lower panel held between said main part and the framework member.

5. A panel fitting device according to claim 1 including a curved relief part connected between each support leg and each respective main part.

6. A panel fitting device according to claim 2, wherein said panel pressing section is bow-shaped.

7. A panel fitting device according to claim 1, wherein each of said supporting legs extends obliquely downwardly and outwardly from each other.

8. A panel fitting device according to claim 1, wherein each of said supporting legs cross and extend downwardly and obliquely to each other.

9. A panel fitting device according to claim 1, including a curved part connected between each main part and each pressing part.

10. A panel fitting device according to claim 1, including a curved relief part connected between each pressing part and each connected supporting leg, each main and pressing part, each supporting leg, hitching part, curved relief part and panel pressing sectio made of a single piece of bent wire rod.

* * * * *

UNITED STATES PATENT AND TRADEMARK OFFICE

CERTIFICATE OF CORRECTION

PATENT NO. : 4,422,278

DATED : December 27, 1983

INVENTOR(S) : Fujihiro et al.

It is certified that error appears in the above-indentified patent and that said Letters Patent is hereby corrected as shown below:

Title page, item [73], change "Toko" to --Toto--.

Signed and Sealed this

Fourth Day of January, 1994

Bruce Lehman

*Attest:*

BRUCE LEHMAN

*Attesting Officer*

*Commissioner of Patents and Trademarks*